US009280936B2

(12) United States Patent
Delfs et al.

(10) Patent No.: US 9,280,936 B2
(45) Date of Patent: Mar. 8, 2016

(54) IMAGE DISPLAY UNIT, MOBILE PHONE AND METHOD WITH IMAGE ADJUSTMENT ACCORDING TO DETECTED AMBIENT LIGHT

(71) Applicants: Christoph Delfs, Bretten (DE); Saravanan Jayaprakash, Bangalore (IN)

(72) Inventors: Christoph Delfs, Bretten (DE); Saravanan Jayaprakash, Bangalore (IN)

(73) Assignee: ROBERT BOSCH GMBH, Stuttgart (DE)

( * ) Notice: Subject to any disclaimer, the term of this patent is extended or adjusted under 35 U.S.C. 154(b) by 9 days.

(21) Appl. No.: 14/249,527

(22) Filed: Apr. 10, 2014

(65) Prior Publication Data

US 2014/0307008 A1 Oct. 16, 2014

(30) Foreign Application Priority Data

Apr. 16, 2013 (DE) ..... 10 2013 206 832

(51) Int. Cl.
*G09G 3/34* (2006.01)

(52) U.S. Cl.
CPC ..... *G09G 3/3406* (2013.01); *G09G 2320/0666* (2013.01); *G09G 2360/144* (2013.01)

(58) Field of Classification Search
CPC ..... G09G 2360/14–2360/144; G02F 1/13318; G02F 2201/58
See application file for complete search history.

(56) References Cited

U.S. PATENT DOCUMENTS

| | | | | |
|---|---|---|---|---|
| 5,952,992 | A | 9/1999 | Helms | |
| 2002/0120373 | A1* | 8/2002 | Lafon et al. | 701/3 |
| 2002/0153472 | A1* | 10/2002 | Yano | 250/208.1 |
| 2002/0171766 | A1* | 11/2002 | Wada | G09G 3/002 348/602 |
| 2003/0007098 | A1* | 1/2003 | Wada | G09G 5/02 348/603 |
| 2003/0234794 | A1* | 12/2003 | Kanai | G06T 11/001 345/600 |
| 2004/0017550 | A1* | 1/2004 | Yasumi | H04N 5/74 353/31 |
| 2005/0280786 | A1* | 12/2005 | Moiroux et al. | 353/119 |
| 2006/0039017 | A1* | 2/2006 | Park | G09G 3/3607 358/1.9 |
| 2007/0176916 | A1* | 8/2007 | Choe | G09G 3/3406 345/207 |
| 2007/0269126 | A1* | 11/2007 | Choe | G09G 5/02 382/254 |
| 2008/0303918 | A1* | 12/2008 | Keithley | G09G 3/20 348/223.1 |
| 2009/0037966 | A1* | 2/2009 | Rolls et al. | 725/105 |
| 2009/0128530 | A1* | 5/2009 | Ek | G09G 5/00 345/207 |
| 2011/0199350 | A1* | 8/2011 | Wilson | G09G 5/02 345/207 |
| 2013/0082607 | A1* | 4/2013 | Gandhi | G09G 3/3413 315/153 |
| 2014/0085503 | A1* | 3/2014 | Su | G03B 7/16 348/223.1 |
| 2014/0198084 | A1* | 7/2014 | Peana | G09G 3/3406 345/207 |

* cited by examiner

*Primary Examiner* — Gene W Lee
(74) *Attorney, Agent, or Firm* — Kenyon & Kenyon LLP

(57) ABSTRACT

An image display unit for displaying still or moving images, this unit having at least one ambient light sensor which is configured to detect a color and an intensity of an ambient light in the surroundings of the image display unit and this unit also having an intensity control device which is configured to adjust the intensity of each individual image point in the images displayed by the image display unit based on the detected color and intensity of the ambient light. Also described is a related mobile phone and a related method.

21 Claims, 3 Drawing Sheets

IMAGE DISPLAY UNIT, MOBILE PHONE AND METHOD WITH IMAGE ADJUSTMENT ACCORDING TO DETECTED AMBIENT LIGHT

RELATED APPLICATION INFORMATION

The present application claims priority to and the benefit of German patent application no. 10 2013 206 832.8, which was filed in Germany on Apr. 16, 2013, the disclosure of which is incorporated herein by reference.

FIELD OF THE INVENTION

The present invention relates to an image display unit for displaying still or moving images, a corresponding mobile phone, and a corresponding method for displaying still or moving images.

BACKGROUND INFORMATION

There is a plurality of applications in which a user is supposed to be shown images or videos. Here, the images or video may be displayed on display screens or projected onto a screen with the aid of a projector.

In particular in mobile applications, such as in portable devices, e.g., smart phones, tablet PCs, or the like, low energy consumption of the individual components of the device is important in order to achieve what may be long autonomy, i.e., a long running time without having to charge the battery.

However, applications, such as playing videos, generate a high energy consumption. A component which increases the energy consumption in this case is the display device, e.g., the LCD display, of the particular device. Modern mobile devices may, for example, also have video projectors for image or video display whose operation is, however, also associated with high energy consumption.

In order to reduce the energy consumption of the display units of mobile devices, the brightness of an LCD display or of a projector image may be adjusted, for example. This may take place manually, for example.

U.S. Pat. No. 5,952,992 shows a method in which the brightness of an LCD display is set automatically as a function of the illumination of the surroundings.

SUMMARY OF THE INVENTION

The present invention provides an image display unit having the features described herein and a mobile phone having the features described herein, and a method having the features described herein.

Accordingly provided is:

An image display unit for displaying still or moving images, this unit having at least one ambient light sensor which is configured to detect a color and an intensity of an ambient light in the surroundings of the image display unit and this unit also having an intensity control device which is configured to adjust the intensity of each individual image point in the images displayed by the image display unit based on the detected color and intensity of the ambient light.

A mobile phone having an image display unit according to the present invention.

A method for displaying images, including the steps: detecting a color and an intensity of an ambient light in the surroundings of the image display and adjusting the intensity of each individual image point in the displayed images based on the detected color and intensity of the ambient light.

The finding underlying the present invention is that the ambient light has a significant influence on the perception of the images or videos displayed while the images or videos are being displayed.

The idea underlying the present invention is now that this finding is to be taken into account and a method is to be provided in which the display of images or videos is adjusted based on the color and intensity of the ambient light in order to reduce the energy demand of the particular display, without impairing the perception.

The present invention provides that both the color and the intensity of the ambient light are measured in the area of the image display unit with the aid of an ambient light sensor.

With the aid of an intensity control device, the intensity of each individual image point of an image to be displayed is adjusted based on the color and the intensity of the ambient light.

The present invention thus makes it possible, on the one hand, to influence the brightness of the entire image. On the other hand, the present invention makes it possible to influence every single image point of an image, thus reducing the energy consumption of an image display unit, without excessively impairing the quality of the perceived display.

In modern image display units, individual image points may usually be directly activated, e.g., in plasma screens or projectors having a laser or an LED light source. In LCD monitors having an LED backlight, at least individual areas of the LCD monitor having different intensity and color may be activated.

Advantageous specific embodiments and refinements result from the subclaims as well as from the description with reference to the figures.

In one specific embodiment, the intensity control device has an image point determination device which is configured to determine those image points in the images displayed by the image display unit whose color deviates maximally by a predefined color value from the detected color of the ambient light. Furthermore, the intensity control device has an image point control device which is configured to assign a reduced intensity to the determined image points.

If, for example, images are projected by a computer via an image display unit according to the present invention onto a white wall, it may frequently happen in the case of text documents, for example, that a large part of the displayed image content is also white. In such an application case, it is then possible to significantly reduce the energy consumption of the image display unit with the aid of the present invention if a reduced intensity is predefined for the white image points.

In one specific embodiment, the intensity of individual image points may be reduced to zero, i.e., these image points are not explicitly displayed by the image display unit. These image points are rather illuminated on a screen by the ambient light, for example, and thus implicitly displayed.

In one specific embodiment, the intensity control device has a user interface which is configured to detect image areas in the images which are displayed by the image display unit and which are of particular interest to the user.

If those areas are individually detected which may be of great interest to the user, it becomes possible to treat these areas separately and to individually adjust the intensity of the image points in these areas.

In one specific embodiment, the intensity control device is configured to increase the intensity of the image points of the detected image areas in the images which are displayed by the image display unit and/or to reduce the intensity of the image points which do not belong to the detected image areas in the images which are displayed by the image display unit. This allows for additional energy savings, for example, since it becomes possible to also reduce the intensity of image points whose color does not correspond to the color of the ambient light.

In one specific embodiment, the user interface is configured to request the coordinates of the image areas from a user. This allows for a very simple detection of the image areas which may be of interest to the user.

In one specific embodiment, the user interface is configured to define the image areas as the surroundings of a cursor which is controlled by the user in the images displayed by an image display unit. This allows for an automatic detection of the image areas which may be of interest to the user, even if they dynamically change. In this case, the surroundings may be defined, for example, as a circular image section around the position of the cursor. In one specific embodiment in which the images are provided by a computer, for example, the surroundings may also be the program or the application window over which the cursor is hovering. Additional embodiments of the surroundings are also possible.

In one specific embodiment, the intensity control device has an image analysis device which is configured to identify those areas in the images which are displayed by the image display unit and which show movement as the areas which are of particular interest to the user. This allows for an automatic identification of those areas which may be of interest to a user or a viewer even if a cursor is not moved by a user. This may be the case during the display of movies or videos, for example.

In one specific embodiment, the image display unit has a projection device which is configured to project images onto a projection surface.

In one specific embodiment, the ambient light sensor is configured to detect the color of the projection surface onto which the projection device projects the images. Furthermore, the intensity control device is configured to adjust the intensity of each individual image point in the images which are projected by the projection device based on the detected color of the projection surface. If the color of the projection surface is also detected in addition to the ambient light, the activation of individual image points may be further optimized. This means that the energy consumption of the image display unit may be further reduced, without excessively impairing the image quality. In this case, the evaluation of the ambient light sensor information may take place once at the beginning of the projection or also cyclically, e.g., in the time interval between two displayed image (sections), and thus cause the intensity control device to be permanently updated.

In another specific embodiment, a camera is employed as the ambient light sensor whose image may be used to evaluate a piece of local ambient light information, i.e., depending on the resolution of the camera, precise pixel adjustments may be possible for the intensity control, if necessary.

In one specific embodiment, the ambient light sensor and/or the intensity control device is/are situated in a video source which is coupled to a display device of the image display unit. If the ambient light sensor and/or the intensity control device is/are situated directly in the video source, an already adjusted video data stream may be transmitted to the display device. In this way, the complexity of the display device may be kept to a minimum.

In one specific embodiment, the ambient light sensor and/or the intensity control device is/are situated in the projection device or the display device of the image display unit. This makes it possible for the display device to be coupled to any types of video sources, while still being able to reduce the energy consumption of the image display unit.

The above-mentioned embodiments and refinements may be combined in any desired manner, provided that the combination is reasonable. Other possible embodiments, refinements, and implementations of the present invention also include not explicitly named combinations of features of the present invention described previously or in the following with regard to the exemplary embodiments. In particular, those skilled in the art will add individual aspects as improvements or enhancements to the particular base form of the present invention.

The present invention is elucidated below in greater detail with reference to the exemplary embodiments indicated in the schematic figures of the drawings.

In all figures, elements and devices which are identical or have identical functions are identified with identical reference numerals, unless otherwise indicated.

DETAILED DESCRIPTION

Figure 1:
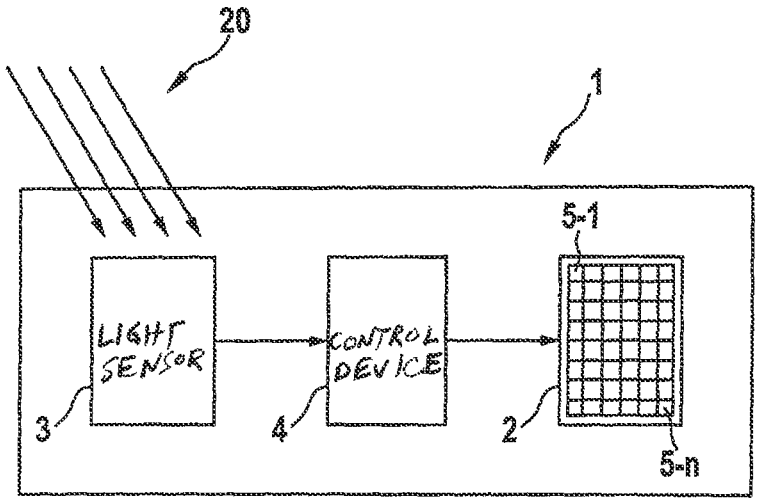
FIG. 1 shows a block diagram of one specific embodiment of an image display unit according to the present invention.

FIG. 1 shows a block diagram of one specific embodiment of an image display unit 1 according to the present invention.

Image display unit 1 in FIG. 1 has an ambient light sensor 3 which is coupled to an intensity control device 4.

Ambient light sensor 3 detects both the color and the intensity of ambient light 20 in the surroundings of image display unit 1 and makes this information available to intensity control device 4.

Intensity control device 4 then adjusts the intensity of each individual image point 5-1-5*n* in image 2 which represents image display unit 1.

During the intensity adjustment of individual image points 5-1-5-*n*, the intensity may be in particular reduced, but it may also be reduced to zero.

In one specific embodiment, image display unit 1 is integrated into a mobile phone 15, and ambient light sensor 3 may be a camera which is integrated into mobile phone 15.

Figure 2:
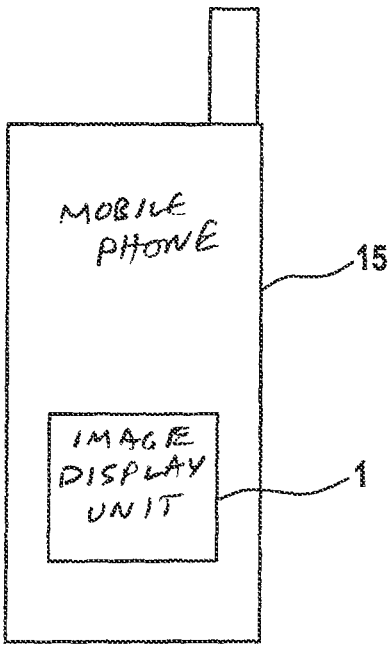
FIG. 2 shows a block diagram of one specific embodiment of a mobile phone according to the present invention.

FIG. 2 shows a block diagram of one specific embodiment of a mobile phone 15 according to the present invention.

Mobile phone 15 in FIG. 2 has an image display unit 1 according to the present invention. The other components of mobile phone 15 are not illustrated in FIG. 2.

In one specific embodiment, mobile phone 15 is a smart phone and has a data memory which contains video data, for example, which may be displayed via a video projector which is integrated into mobile phone 15. For this purpose, mobile phone 15 may have a video decoder, for example, which may be implemented in software or in hardware.

Mobile phone 15 may also be configured to receive videos as a video stream via a data link and to display the received videos.

Figure 3:
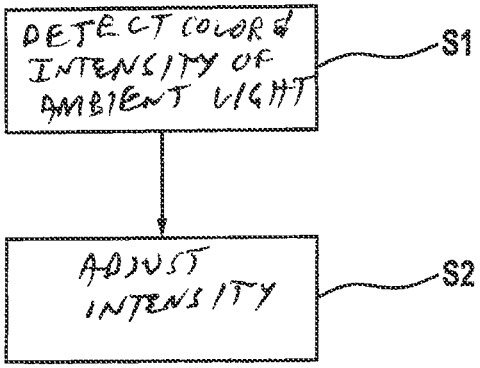
FIG. 3 shows a flow chart of one specific embodiment of a method according to the present invention.

FIG. 3 shows a flow chart of one specific embodiment of a method according to the present invention for displaying images 2.

The method provides in a first step S1 the detection of a color and an intensity of an ambient light 20 in the surroundings of the image display. In a second step S2, the method provides the adjustment of the intensity of each individual image point 5-1-5-*n* in displayed images 2 based on the detected color and intensity of ambient light 20.

The image content may be displayed after the intensity has been adjusted. Here, the display may take place on a display screen or via a projector, for example.

In one specific embodiment, those image points 5-1-5-*n* in displayed images 2 are determined for adjustment S2 of the intensity whose color deviates maximally by a predefined color value from the detected color of ambient light 20.

Here, the deviation from the color of the ambient light may be indicated in a wavelength, for example. The deviation from the color of the ambient light may, however, also be indicated, for example, in the RGB color space, in the CMYK color space, or the like.

In one specific embodiment, image areas 17 which are of particular interest to a user are detected in displayed images 2 for adjustment S2 of the intensity. Furthermore, the intensity of image points 5-1-5-*n* of detected image areas 17 may be increased in displayed images 2. Additionally or alternatively, the intensity of image points 5-1-5-*n* which do not belong to detected image areas 17 may be reduced in displayed images 2.

In one specific embodiment, the coordinates of image areas 17 are requested from a user for detection of image areas 17.

In one specific embodiment, image areas 17 are defined as the surroundings of a cursor 9 which is controlled by the user in displayed images 2 for detection of image areas 17.

In one specific embodiment, areas in displayed images 2, which show movement, are identified for detection of image areas 17 as areas 17 which are of particular interest to the user.

In one specific embodiment, images 2 are projected onto a projection surface 12. Furthermore, the color of projection surface 12 is detected onto which images 2 are projected, and the intensity of each individual image point 5-1-5-*n* in projected images 2 is adjusted based on the detected color of projection surface 12.

Figure 4:
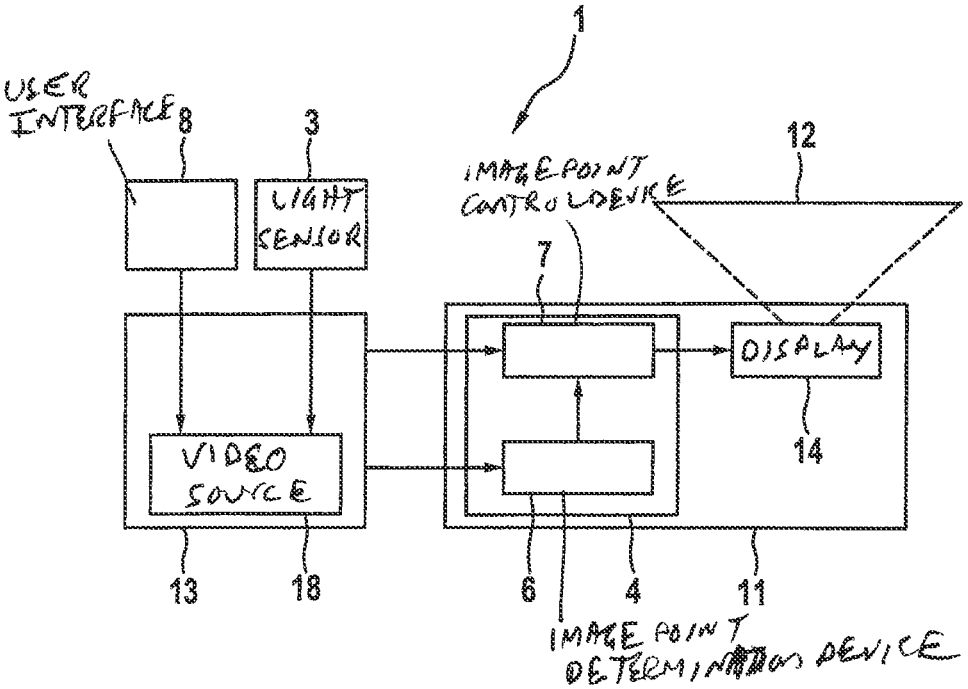
FIG. 4 shows a block diagram of one specific embodiment of an image display unit according to the present invention.

FIG. 4 shows a block diagram of one specific embodiment of an image display unit 1 according to the present invention.

Image display unit 1 in FIG. 4 differs from image display unit 1 in FIG. 1 in that image display unit 1 has a video source 13 which is coupled to an ambient light sensor 3 and to a user interface 8. Furthermore, video source 13 has a computing device 18 which is configured to evaluate ambient light sensor 3 and to evaluate the input of the user via user interface 8. Video source 13 is coupled to projection device 11 via a video interface 19.

In image display unit 1 in FIG. 4, a projection device 11 is furthermore provided in which intensity control device 4 of image display unit 1 has an image point determination device 6 and an image point control device 7, which are coupled to one another. Image point control device 7 is, in turn, coupled to a display device 14.

Computing device 18 is configured to make the data of ambient light sensor 3 and the input of a user received via user interface 8 available to image point determination device 6. Image point determination device 6 determines individual image points 5-1-5-*n* whose intensity is to be adjusted and communicates this information to image point control device 7.

Image point control device 7 adjusts the video data, which it received in a video data stream from video source 13 via video interface 19, in accordance with the information of image point determination device 6 and transmits the adjusted video data to display device 14. Display device 14 then projects the video data onto projection surface 12.

In another specific embodiment, image display unit 1 does not have a projection device 11, but a display screen, e.g., as a plasma screen. In such a specific embodiment, image determination device 6 and image point control device 7 are situated in the display screen.

Figure 5:
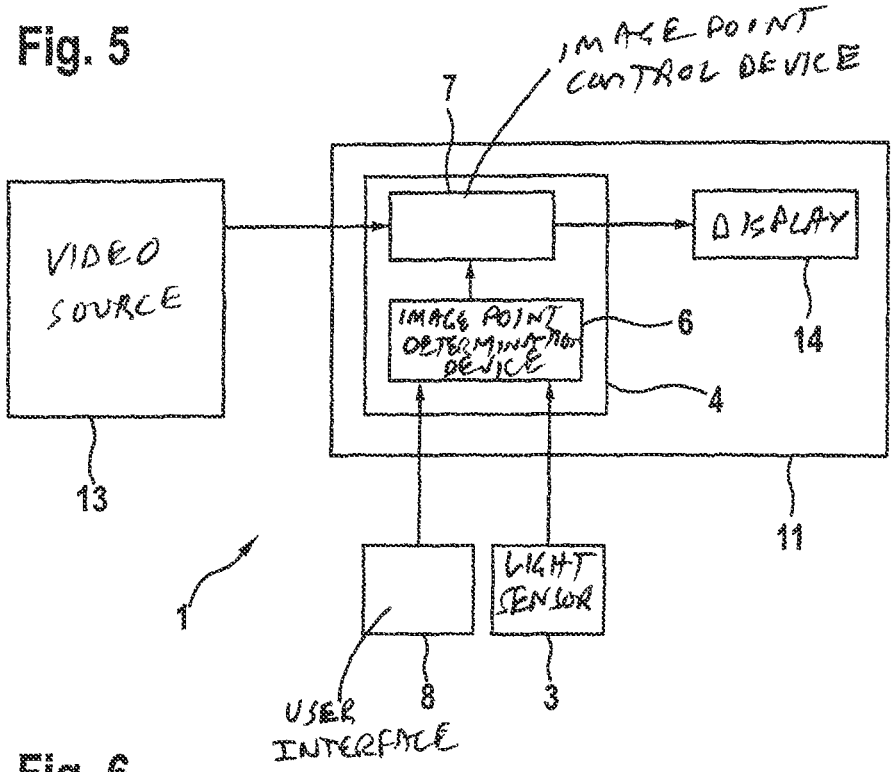
FIG. 5 shows a block diagram of one specific embodiment of an image display unit according to the present invention.

FIG. 5 shows a block diagram of one specific embodiment of an image display unit 1 according to the present invention.

Image display unit 1 in FIG. 5 differs from image display unit 1 in FIG. 4 in that ambient light sensor 3 and user interface 8 are not coupled to video source 13. Ambient light sensor 3 and user interface 8 are coupled to image point determination device 6 of projection device 11 in FIG. 5.

The specific embodiment of image display device 1 in FIG. 5 is particularly suited for use together with video sources which are not specifically configured for use together with an image display unit according to the present invention or a projection device 11 according to the present invention.

Figure 6:
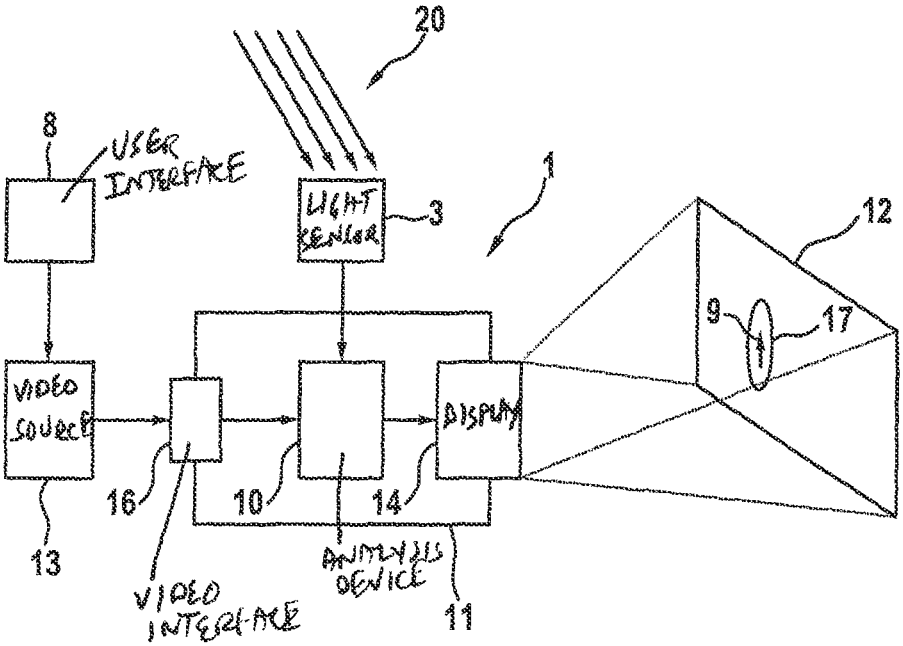
FIG. 6 shows a block diagram of one specific embodiment of an image display unit according to the present invention.

FIG. 6 shows a block diagram of one specific embodiment of an image display unit 1 according to the present invention.

FIG. 6 shows an image display unit 14 having a projection device 11 which is coupled to a video source 13 via a video interface 16.

Video source 13 is coupled to a user interface 8 in order to request input from a user. In one specific embodiment, video source 13 may be a commercially available computer and user interface 8 may be a mouse or a keyboard.

In one specific embodiment, video interface 16 may be configured as an HDMI, a DVI, a VGA interface or the like.

Projection device 11 has an image analysis device 10 which is configured to analyze the video data received by video interface 16. Here, image analysis device 10 identifies those image areas in the video data which could be of interest to a user. In one specific embodiment, image analysis device 16 identifies those image areas which show movement. In another specific embodiment, image analysis device 16 identifies those image areas, for example, which display the window of an application which is being carried out on computer 13.

Image analysis device 16 in FIG. 6 furthermore integrates intensity control device 4 having image point determination device 6 and image point control device 7 (not illustrated in FIG. 6 for the sake of simplicity) and connects ambient light sensor 3 to projection device 11. Finally, projection device 11 has a display device 14 which is configured to project the video data as an image or a video onto projection surface 12.

Ambient light sensor 3 may furthermore be configured to detect the color of the projection surface.

FIG. 6 furthermore shows a cursor 9 on the projection surface which is projected by display device 14 onto projection surface 12 as part of the projected image. Around cursor 9, an area is displayed which highlights an area around the cursor which is of interest to a user. The cursor may, for example, be a cursor which represents a movement of a mouse by the user.

Although the present invention was described above with reference to exemplary embodiments, it is not limited thereto, but is modifiable in many ways. In particular, the present invention may be changed or modified in various ways without deviating from the core of the present invention.

In particular, the terms image, in particular still or moving image, and video are interchangeable in the present patent application.

Furthermore, parts of the devices or methods described herein may be configured as computer program modules which are carried out by a program-controlled computing device or by a computer.

What is claimed is:

1. An image display unit for displaying still or moving images, comprising:

at least one ambient light sensor to detect a color and an intensity of an ambient light in a surroundings of the image display unit; and an intensity control device to adjust the intensity of each individual image point in the images which are displayed by the image display unit based on the detected color and intensity of the ambient light;

wherein the intensity control device includes an image point determination device configured to determine those image points in the images displayed by the image display unit whose color deviates maximally by a predefined color value from the detected color of the ambient light.

2. The image display unit of claim 1, wherein the intensity control device includes an image point control device configured to assign a reduced intensity to the determined image points.

3. The image display unit of claim 1, wherein one of the following is satisfied: (i) at least one of the ambient light sensor and the intensity control device is situated in a video source which is coupled to a display device of the image display unit, and (ii) at least one of the ambient light sensor and the intensity control device is situated in the display device or the projection device of the image display unit.

4. The image display unit of claim 1, wherein the image display unit includes a projection device configured to project the images onto a projection surface.

5. The image display unit of claim 4, wherein the ambient light sensor is configured to detect the color of the projection surface onto which the images are projected by the projection device, and wherein the intensity control device is configured to adjust the intensity of each individual image point in the images which are projected by the projection device based on the detected color of the projection surface.

6. The image display unit of claim 1, wherein the intensity control device includes a user interface to detect image areas in the images which are displayed by the image display unit and which are of particular interest to the user, and wherein the intensity control device is configured to at least one of (i) increase the intensity of the image points of the detected image areas in the images which are displayed by the image display unit, and (ii) reduce the intensity of the image points which do not belong to the detected image areas in the images displayed by the image display unit.

7. The image display unit of claim 6, wherein the user interface is configured to at least one of: (i) request coordinates of the image areas from a user, and (ii) define the image areas as the surroundings of a cursor which is controlled by the user in the images displayed by the image display unit.

8. The image display unit of claim 6, wherein the intensity control device includes an image analysis device configured to identify those areas in the images which are displayed by the image display unit and which show movement as the areas which are of particular interest to the user.

9. A mobile phone, comprising:

an image display unit for displaying still or moving images, including:

at least one ambient light sensor to detect a color and an intensity of an ambient light in a surroundings of the image display unit; and an intensity control device to adjust the intensity of each individual image point in the images which are displayed by the image display unit based on the detected color and intensity of the ambient light;

wherein the intensity control device includes an image point determination device configured to determine those image points in the images displayed by the image display unit whose color deviates maximally by a predefined color value from the detected color of the ambient light.

10. The mobile phone of claim 9, wherein the intensity control device includes an image point control device configured to assign a reduced intensity to the determined image points.

11. The mobile phone of claim 9, wherein one of the following is satisfied: (i) at least one of the ambient light sensor and the intensity control device is situated in a video source which is coupled to a display device of the image display unit, and (ii) at least one of the ambient light sensor and the intensity control device is situated in the display device or the projection device of the image display unit.

12. The mobile phone of claim 9, wherein the image display unit includes a projection device configured to project the images onto a projection surface.

13. The mobile phone of claim 12, wherein the ambient light sensor is configured to detect the color of the projection surface onto which the images are projected by the projection device, and wherein the intensity control device is configured to adjust the intensity of each individual image point in the images which are projected by the projection device based on the detected color of the projection surface.

14. The mobile phone of claim 9, wherein the intensity control device includes a user interface to detect image areas in the images which are displayed by the image display unit and which are of particular interest to the user, and wherein the intensity control device is configured to at least one of (i) increase the intensity of the image points of the detected image areas in the images which are displayed by the image display unit, and (ii) reduce the intensity of the image points which do not belong to the detected image areas in the images displayed by the image display unit.

15. The mobile phone of claim 14, wherein the user interface is configured to at least one of: (i) request coordinates of the image areas from a user, and (ii) define the image areas as the surroundings of a cursor which is controlled by the user in the images displayed by the image display unit.

16. The mobile phone of claim 14, wherein the intensity control device includes an image analysis device configured to identify those areas in the images which are displayed by the image display unit and which show movement as the areas which are of particular interest to the user.

17. A method for displaying still or moving images, the method comprising:

detecting a color and an intensity of an ambient light in the surroundings of the image display; and adjusting the intensity of each individual image point in the displayed images based on the detected color and intensity of the ambient light;

wherein in the adjusting of the intensity, those image points in the displayed images are determined whose color deviates maximally by a predefined color value from the detected color of the ambient light.

18. The method of claim 17, wherein a reduced intensity is assigned to the determined image points.

19. The method of claim 17, wherein the images are projected onto a projection surface, wherein the color of the projection surface is detected onto which the images are projected, and wherein the intensity of each individual image point is adjusted in the projected images based on the detected color of the projection surface.

20. The method of claim 17, wherein in the adjusting the intensity, those image areas are detected in the displayed images which are of particular interest to a user, and at least one of (i) the intensity of the image points of the detected image areas in the displayed images is increased, and (ii) the intensity of the image points which do not belong to the detected image areas in the displayed images is reduced.

21. The method of claim 20, wherein at least one of (i) in the detecting of the image areas, coordinates of the image areas are requested from the user, (ii) in the detecting of the image areas, the image areas are defined as the surroundings of a cursor controlled by the user in the displayed images, and (iii) in the detecting of the image areas, areas in the displayed images which show movement are identified as areas which are of particular interest to the user.

* * * * *